US009057294B2

(12) United States Patent
Kitajima

(10) Patent No.: US 9,057,294 B2
(45) Date of Patent: Jun. 16, 2015

(54) ENGINE PROVIDED WITH LUBRICATING STRUCTURE

(71) Applicant: SUZUKI MOTOR CORPORATION, Shizuoka-Ken (JP)

(72) Inventor: Hiroki Kitajima, Shizuoka-Ken (JP)

(73) Assignee: SUZUKI MOTOR CORPORATION, Hamamatsu-Shi, Shizuoka-Ken (JP)

( * ) Notice: Subject to any disclaimer, the term of this patent is extended or adjusted under 35 U.S.C. 154(b) by 97 days.

(21) Appl. No.: 13/664,571

(22) Filed: Oct. 31, 2012

(65) Prior Publication Data

US 2013/0104839 A1 May 2, 2013

(30) Foreign Application Priority Data

Oct. 31, 2011 (JP) ..... 2011-239210

(51) Int. Cl.

| | |
|---|---|
| ***F01M 9/10*** | (2006.01) |
| ***F01M 1/04*** | (2006.01) |
| ***F01M 3/04*** | (2006.01) |
| ***F01M 11/02*** | (2006.01) |
| *F01M 3/00* | (2006.01) |
| *F01M 1/16* | (2006.01) |

(52) U.S. Cl.

CPC ..... *F01M 11/02* (2013.01); *F01M 3/00* (2013.01); *F01M 1/04* (2013.01); *F01M 9/10* (2013.01); *F01M 1/16* (2013.01); *F01M 2011/023* (2013.01)

(58) Field of Classification Search

CPC ..... F01M 11/02; F01M 1/02; F01M 1/04; F01M 1/16; F01M 3/04; F01M 9/10; F01M 3/00; F02B 2075/027; F02B 2075/025

USPC ..... 123/196 R, 196 CP, 196 M

See application file for complete search history.

(56) References Cited

U.S. PATENT DOCUMENTS

| | | | | |
|---|---|---|---|---|
| 6,116,205 | A * | 9/2000 | Troxler et al. | 123/196 R |
| 7,287,508 | B2 * | 10/2007 | Kurihara | 123/196 R |
| 2011/0120409 | A1 * | 5/2011 | Saitou et al. | 123/196 R |

FOREIGN PATENT DOCUMENTS

JP 2000282826 A 10/2000

* cited by examiner

*Primary Examiner* — Lindsay Low
*Assistant Examiner* — Syed O Hasan
(74) *Attorney, Agent, or Firm* — Barnes & Thornburg LLP

(57) ABSTRACT

A single cylinder engine includes a crankcase having a crank chamber, a crankshaft disposed in the crank chamber of the crank case and having a crank web with a side surface perpendicular to a rotating shaft of an engine, and a lubricating structure for lubricating oil to components in the engine. The lubricating structure includes an oil reservoir communicating with the crank chamber through an oil discharge port formed to the crank chamber under the crank chamber, and an oil discharge groove formed to the crankcase for discharging oil flying from the crank web into the oil reservoir, the oil discharge groove being provided in a side wall of the crankcase facing a side surface of the crank web in the crank chamber.

7 Claims, 9 Drawing Sheets

A-A SECTION

B-B SECTION

C-C SECTION

D-D SECTION

ENGINE PROVIDED WITH LUBRICATING STRUCTURE

This patent application claims priority to Japanese Patent Application No. 2011-239210,filed 31Oct. 2011, the disclosure of which is incorporated herein by reference in its entirety.

BACKGROUND OF THE INVENTION

1. Field of the Invention

The present invention relates to an engine provided with a lubricating structure, and more specifically, to a single cylinder engine applied to, for example, a motorcycle, provided with an improved lubrication structure.

2. The Related Art

In a single cylinder engine is provided with a crankcase in which a crankshaft extends and with a lubrication structure, so-called forced lubrication-type engine that supplies oil to a surface to be lubricated using an oil pump. The oil, after lubricating a piston of a cylinder and the crankshaft, falls by gravity, and accumulates in an oil reservoir provided below the crankcase of the engine. The oil that has accumulated in the oil reservoir is again pumped by the oil pump and supplied to each of components or parts of the engine.

In such a lubricating structure, the oil after lubricating the piston or the crankshaft passes between a wall that partitions a crank chamber and the crankshaft when falling toward the oil reservoir. At this time, if such oil is not efficiently discharged, the oil stores or remains between the crankshaft and the crank chamber, which causes rotational resistance of the crankshaft and reduces output of the engine. In addition, if the crankshaft rotating at high speed stirs the oil, air may be mixed into the oil, causing oil film shortage in an area to be lubricated, which may cause wear or seizure, thus being inconvenient.

In order to solve these inconveniences mentioned above, there is provided an engine having a lubricating structure achieving an increased discharge performance of oil from a crank chamber (for example, refer to Patent Document 1: Japanese Patent Laid-Open Publication No. 2000-282826). In the lubricating structure described in the Patent Document 1, a space between an inner surface of a crankcase and an outer periphery of a crank web is narrowed on a downstream side of an oil discharge port in a rotational direction of a crankshaft to thereby limit an amount of oil flowing downstream in the rotational direction through the oil discharge port, and hence, increase a discharge performance of oil from a crank chamber.

However, in the lubricating structure of the engine described above, the narrow space is provided between the inner surface of the crankcase and the outer periphery of the crank web on the downstream side in the rotational direction, and thus, the rotational resistance of the crankshaft is further increased by drag resistance. Because of this reason, in application of the lubricating structure described above, it is difficult to maximize output of an engine.

In order to increase discharge performance of oil while reducing the drag resistance of oil in the lubricating structure described above, it is conceivable that a radial space between an inner surface of a crankcase and an outer periphery of a crank web is increased.

In such structure, it is particularly necessary to provide a sufficiently wide radial space between the inner surface of the crankcase and the outer periphery of the crank web in order to ensure an oil discharge path on an upstream side in a rotational direction. If the oil discharge path is to be thus ensured in a radial direction of the crank web, the crankcase has to be significantly widened in the radial direction of the crank web, which undesirably increases a size of an engine.

SUMMARY OF THE INVENTION

The present invention was conceived in consideration of the circumstances mentioned above, and an object thereof is to provide a single cylinder engine provided with an improved lubricating structure capable of increasing discharge performance of an oil from a crank chamber of the engine without increasing rotational resistance of a crankshaft and without widening a crankcase in the radial direction of a crank web.

The above and other objects can be achieved according to the present invention by providing an engine provided with a lubricating structure including: a crankcase having a crank chamber; a crankshaft disposed in the crank chamber of the crank case and having a crank web with a side surface perpendicular to a rotating shaft of an engine; and a lubricating structure for lubricating an oil to components in the engine, the lubricating structure including an oil reservoir communicating with the crank chamber through an oil discharge port formed to the crank chamber under the crank chamber, and an oil discharge groove formed to the crankcase for discharging oil flying from the crank web into the oil reservoir, the oil discharge groove being provided in a side wall of the crankcase facing a side surface of the crank web in the crank chamber. It is preferred that the above engine is a single cylinder engine.

According to the engine provided with the lubricating structure of the characters mentioned above, the oil discharge groove is provided in the side wall of the crankcase facing the side surface of the crank web, so that the oil flying from the crank web can be efficiently discharged from the crank chamber to sufficiently reduce an amount of oil accumulating between the crankshaft and the crank chamber.

Furthermore, since it is not necessary to narrow a space between an inner surface of the crankcase and an outer peripheral surface of the crank web, an increase in rotational resistance of the crankshaft can be prevented. In addition, since the oil discharge groove is provided in the side wall of the crankcase facing the side surface of the crank web, it is also not necessary to widen a space between the crankcase and the crank web and not to widen the crankcase in the radial direction of the crank web. Therefore, the single cylinder engine having the lubricating structure according to the present invention, the discharge performance of the oil from the crank chamber can be enhanced without increasing rotational resistance of the crankshaft and widening the crankcase in the radial direction of the crank web.

In a preferred example of the lubricating structure of the single cylinder engine, the crank web may a disk shape, and the oil discharge groove has an arcuate shape around a rotating shaft of the crankshaft in a region corresponding to an outer peripheral portion of the crank web.

In the lubricating structure, groove may be preferably provided to an end of the side wall of the crankcase.

It may be desired for the oil discharge groove to be provided to be deeper in a vehicle width direction toward the oil reservoir.

It may be preferred that the oil discharge groove is provided below the rotating shaft of the crankshaft.

It may be desired that the oil discharge groove is provided on an upstream side of the oil discharge port in a rotational direction of the crankshaft.

It may be further preferred that the oil discharge groove is provided on an upstream side of the oil discharge port in a rotational direction of the crankshaft.

According to the preferred examples mentioned above, the following advantageous effects will be achieved.

Since the oil discharge groove is provided in the region corresponding to the outer peripheral portion of the crank web, the oil flying from the outer peripheral portion of the crank web due to rotation of the crankshaft can be efficiently discharged through the oil discharge groove.

Further, since the oil discharge groove is provided to the end of the side wall of the crankcase, a capacity of the oil discharge groove can be increased to thereby ensure efficient discharge of a large amount of oil.

Furthermore, the oil discharge groove is formed to be deeper on a side of the oil reservoir where oil easily accumulates, thus realizing the efficient discharge of the oil.

In addition, since the oil discharge groove is provided below the rotating shaft of the crankshaft, re-adhesion of the oil from the oil discharge groove to the crankshaft, discharge performance of oil can be enhanced.

Since the oil discharge groove may be provided on the upstream side of the oil discharge port, and oil flowing from the upstream side is discharged through the oil discharge groove from the oil discharge port, the discharge performance of oil can be also realized.

In summary, according to the present invention, the discharge performance of oil from the crank chamber can be enhanced without increasing the rotational resistance of the crankshaft and without widening the crankcase in the radial direction of the crank web.

The nature and further characteristic features of the present invention will be made clearer from the following descriptions made with reference to the accompanying drawings.

BRIEF DESCRIPTION OF THE DRAWINGS

In the accompanying drawings:

FIG. 9 includes schematic diagrams of a configuration of an oil discharge groove, in which

DESCRIPTION OF THE PREFERRED EMBODIMENT

An embodiment of the present invention will be described hereunder in detail with reference to the accompanying drawings.

An example of a single cylinder engine (which may be simply referred to as an engine, hereinafter) provided with an improved lubricating structure according to the present invention is applied to an off-road motorcycle as will be described hereunder. However, it is to be noted that the present embodiment is not limited to the described one, and the single cylinder engine provided with the lubricating structure according to the present invention may be applied to an engine of motorcycles of different types, four-wheel vehicles, or ships.

Figure 1:
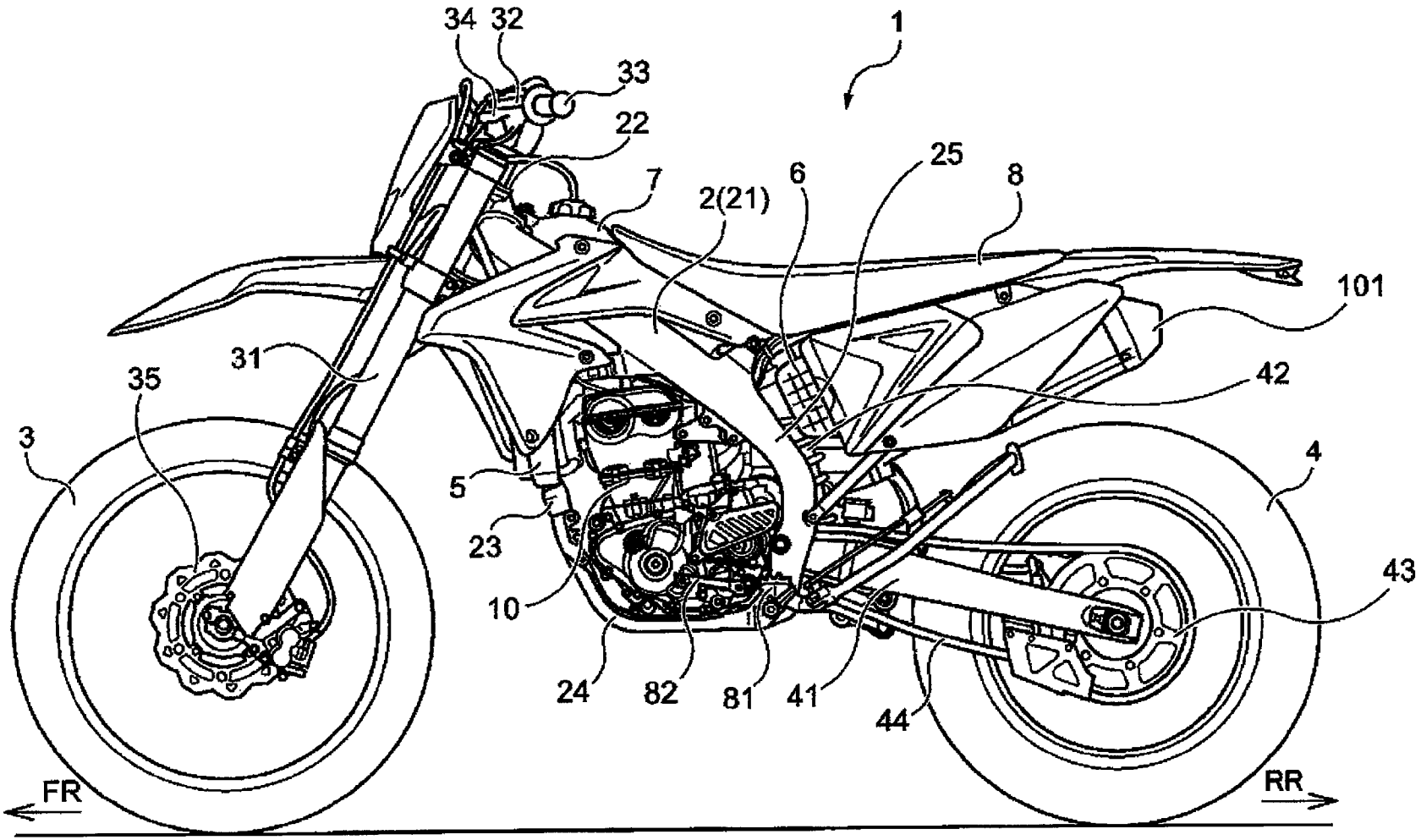
FIG. 1 is a left side view showing an appearance of a motorcycle provided with a single cylinder engine according to an embodiment of the present invention.

An overall configuration of the motorcycle according to the present embodiment will be first described with reference to FIG. 1 showing a left side view of the motorcycle.

In the drawings, a front direction of a vehicle body is denoted by an arrow FR, and a rear direction of the vehicle body is denoted by an arrow RR, and terms showing direction such as upper, lower, right, left and the like are used herein with reference to the illustration of the drawings or in an actual mounting state of the engine.

As shown in FIG. 1, a motorcycle 1 includes a vehicle body frame 2 made of steel or an aluminum alloy, on which components or members constituting the motorcycle 1 are mounted. A main frame 21 of the vehicle body frame 2 branches to left and right sides rearward from a head pipe 22 provided at a front end of the vehicle body frame 2, and extends obliquely downward in a rear direction of the vehicle body. A down tube 23 extending substantially downward from the head pipe 22 branches to left and right sides as lower frames 24 in a lower portion of the vehicle body. The left and right lower frames 24 further extend downward, and are then bent rearward of the vehicle body. Rear ends of the lower frames 24 are coupled to left and right rear ends of the main frame 21 via left and right body frames 25, respectively.

Front forks 31 are rotatably supported at a front end of the vehicle body frame 2 via a steering shaft, now shown, provided on the head pipe 22. A handlebar 32 is connected to an upper end of the steering shaft, and grips 33 are mounted to opposing both ends of the handlebar 32.

A clutch lever 34 is disposed on a left front side of the handlebar 32, and a brake lever, not shown, for a front wheel 3 is disposed on a right front side of the handlebar 32. The front wheel 3 is rotatably supported at a lower portion of each front fork 31. A brake disk 35 that constitutes a brake for the front wheel is provided on the front wheel 3.

Swing arms 41 are coupled to the body frame 25 of the vehicle body frame 2 swingably in a vertical direction, and a suspension 42 is mounted between the vehicle body frame 2 and the swing arms 41. A rear wheel 4 is rotatably supported at a rear portion of each swing arm 41. A rear sprocket (driven sprocket) 43 is provided on a left side of the rear wheel 4 so that a chain 44 transmits power of the engine to the rear wheel 4. A brake disk, not shown, that constitutes a brake for the rear wheel is provided on a right side of the rear wheel 4.

A water-cooled engine unit 10 as a drive source is arranged in a lower position of a space substantially surrounded by the main frame 21, the down tube 23, the lower frame 24, and the body frame 25 of the vehicle body frame 2. A radiator 5 is arranged in front of the engine unit 10, and an air cleaner box 6 including a filter that separates and collects dust in air is disposed on a rear side of the engine unit 10. A fuel tank 7 storing fuel is disposed above the engine unit 10, and a seat 8 is placed on a rear side of the fuel tank 7.

Foot rests 81 are provided under the seat 8. A shift pedal 82 is provided at a front of the foot rest 81 on a left side of the vehicle body, and a brake pedal, not shown, for the rear wheel 4 is provided at a front of the foot rest 81 on a right side of the vehicle body.

The engine unit 10 includes a transversely arranged crank-type four-stroke (four-cycle) single cylinder engine with a rotating shaft of a crankshaft arranged in parallel with the vehicle width direction, and the engine unit 10 also includes a transmission.

Air is taken into the engine unit 10 through the air cleaner box 6, an intake pipe, or the like, and the air and fuel are mixed in a fuel injection device and supplied into a combustion chamber. A combustion gas after combustion is discharged as an exhaust gas from a muffler 101 through an exhaust pipe, not shown, extending rearward on a right side surface of the engine unit 10.

The engine unit 10 also includes a lubricating structure according to the present embodiment.

Figure 2:
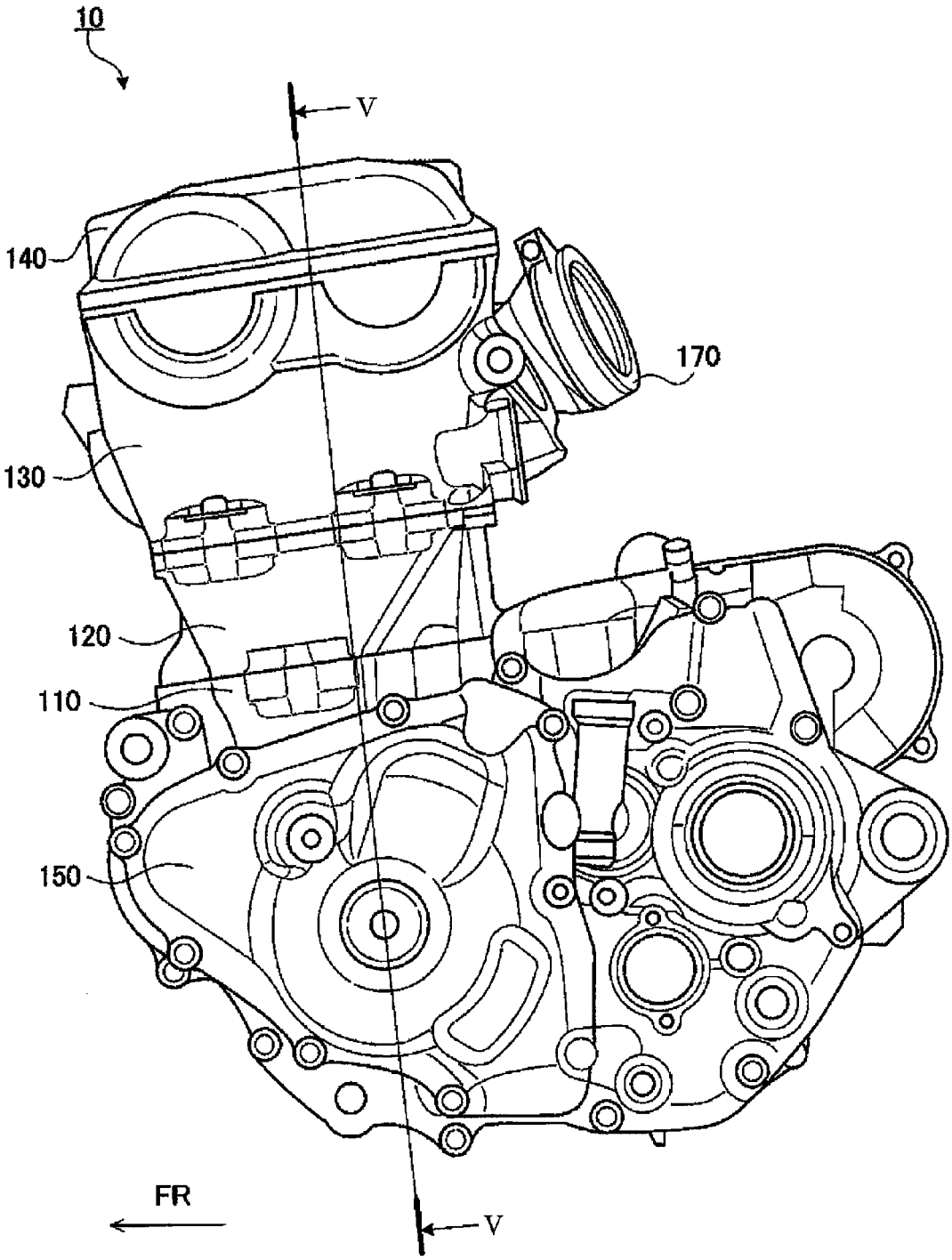
FIG. 2 is a left side view showing an appearance of an engine unit according to the present embodiment.
Figure 3:
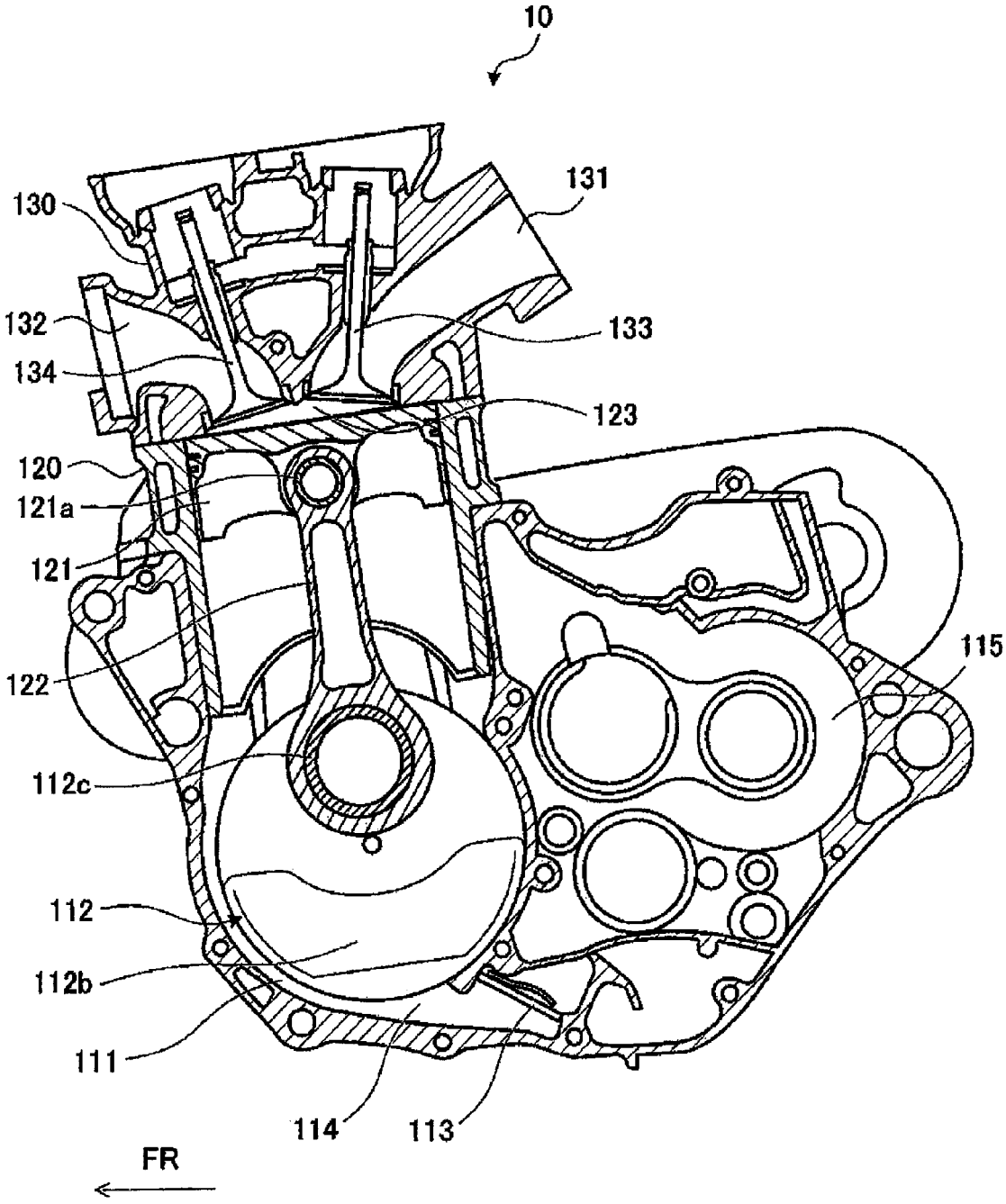
FIG. 3 is a sectional view of the engine unit taken along the line in FIG. 5.
Figure 4:
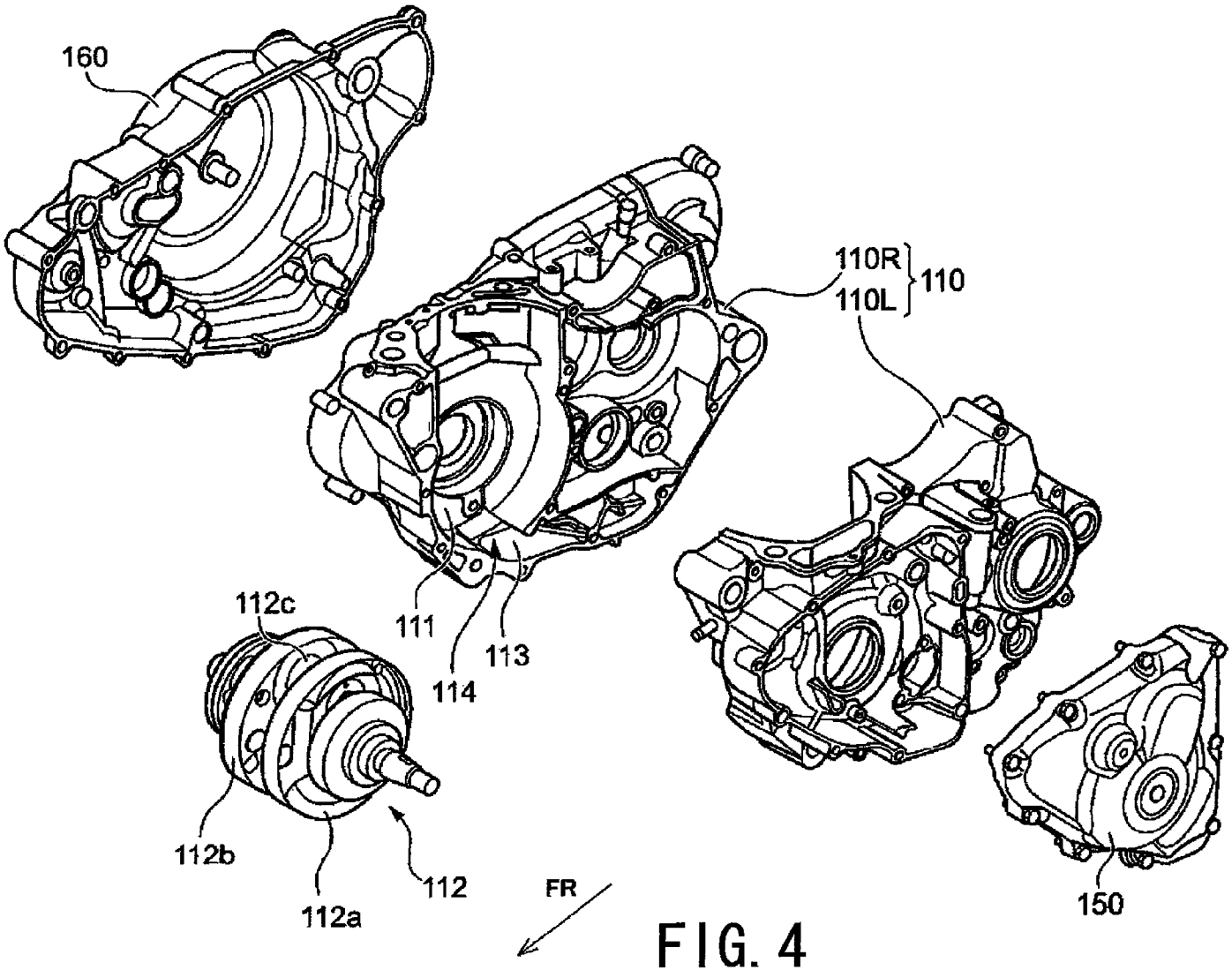
FIG. 4 is an exploded perspective view of the engine unit according to the present embodiment.

FIG. 2 is a side view showing an overall configuration of the engine unit 10 provided with the lubricating structure according to the embodiment. FIG. 3 is a partial sectional view of the engine unit 10 taken along the line in FIG. 5. FIG. 4 is an exploded perspective view of the engine unit 10.

As shown in FIG. 2, in the engine unit 10, a substantially cylindrical cylinder 120 is arranged on a crankcase 110, and a cylinder head 130 and a head cover 140 are mounted to the cylinder 120. A magneto cover 150 is mounted to a left side surface of the crankcase 110.

In addition, as shown in FIG. 4, a clutch cover 160 is mounted to a right side surface of the crankcase 110. The crankcase 110 is constituted by a right crankcase half 110R and a left crankcase half 110L divided into left and right sides on a plane perpendicular to the vehicle width direction. A crank chamber 111 is formed between the right crankcase 110R and the left crankcase 110L.

As shown in FIG. 3, the crank chamber 111 in the crankcase 110 houses a crankshaft 112 so that a rotating shaft is arranged in parallel with the vehicle width direction. The crankshaft 112 includes substantially disk-shaped crank webs 112*a* and 112*b* having side surfaces substantially perpendicular to the rotating shaft, and a crank pin 112*c* that couples the crank webs 112*a* and 112*b* (see FIG. 4). A piston 121 is housed in a cylindrical space inside the cylinder 120 so as to be reciprocable in an axial direction (vertical direction) of the cylinder. The piston 121 and the crankshaft 112 are connected by a connecting rod 122 so that reciprocation of the piston 121 is converted into rotation of the crankshaft 112. The piston 121 is coupled to a small end portion of the connecting rod 122 by a piston pin 121*a*, and the crankshaft 112 is coupled to a large end portion of the connecting rod 122 by a crank pin 112*c*.

In a cylinder head 130, an intake port 131 and an exhaust port 132 are formed. The intake port 131 is for feeding air into a combustion chamber 123 surrounded by an inner wall surface of the cylinder 120, a lower surface of the cylinder head 130, and an upper surface of the piston 121, and the exhaust port 132 is for discharging a combustion gas to an outside of the combustion chamber 123.

Furthermore, the cylinder head 130, an intake valve 133 for opening and closing the intake port 131, and an exhaust valve 134 for opening and closing the exhaust port 132 are provided. In addition, an ignition plug, not shown, protrudes from a lower surface of the cylinder head 130 so that an air/fuel mixture in the combustion chamber 123 can be ignited by electric discharge.

An air intake and exhaust mechanism of the engine unit 10 is DOHC (Double Overhead Camshaft) including two independent camshafts on an intake side and an exhaust side. The two camshafts each includes a cam having a shape according to opening/closing timing of the corresponding intake valve 133 or exhaust valve 134, and the camshafts are arranged so that rotation axes thereof are parallel to the vehicle width direction in an upper portion of the cylinder head 130. One end of each camshaft is coupled to the crankshaft 112 via a power transmission mechanism such as a sprocket or a cam chain. Thus, torque of the crankshaft 112 is transmitted to the camshaft, and the intake valve 133 and the exhaust valve 134 are opened/closed correspondingly to the rotation of the crankshaft 112.

In the engine unit 10 operated by the four-stroke motion as described above, the intake valve 133 is opened when the piston 121 moves down, and an air/fuel mixture is fed into the combustion chamber 123 through an intake pipe 170 and the intake port 131 (intake stroke).

Then, the intake valve 133 is closed, and the piston 121 moves to a position to compress the air/fuel mixture (compression stroke).

When the piston 121 reaches a top dead center, ignition is performed by the ignition plug and the compressed air/fuel mixture burns (combustion stroke).

If combustion of the air/fuel mixture increases pressure in the combustion chamber 123, the piston 121 moves down. The downward movement of the piston 121 is transmitted via the connecting rod 122 to the crankshaft 112 to rotate the crankshaft 112.

When the piston 121 then moves down to the bottom dead center and again moves up by inertia, the exhaust valve 134 is opened and a combustion gas is discharged from the exhaust port 132 (exhaust stroke).

A valve gear (valve train mechanism) including the intake valve 133 and the exhaust valve 134 of the cylinder head 130 allows such an operation as described above.

Surfaces of movable components such as the piston 121 and the crankshaft 112 described above, and components, such as cylinder 120, that come into contact with the movable components are necessary to be lubricated with engine oil to prevent wear or seizure. The engine oil after lubricating the piston 121, the crankshaft 112, the cylinder 120, or the like falls downward by gravity, and is collected on a bottom of the crank chamber 111. As shown in FIGS. 3 and 4, an oil reservoir (oil storing chamber or space) 113 in which the engine oil that has fallen downward is provided on the bottom of the crank chamber 111. The oil reservoir 113 communicates with the crank chamber 111 through the oil discharge port 114.

Figure 5:
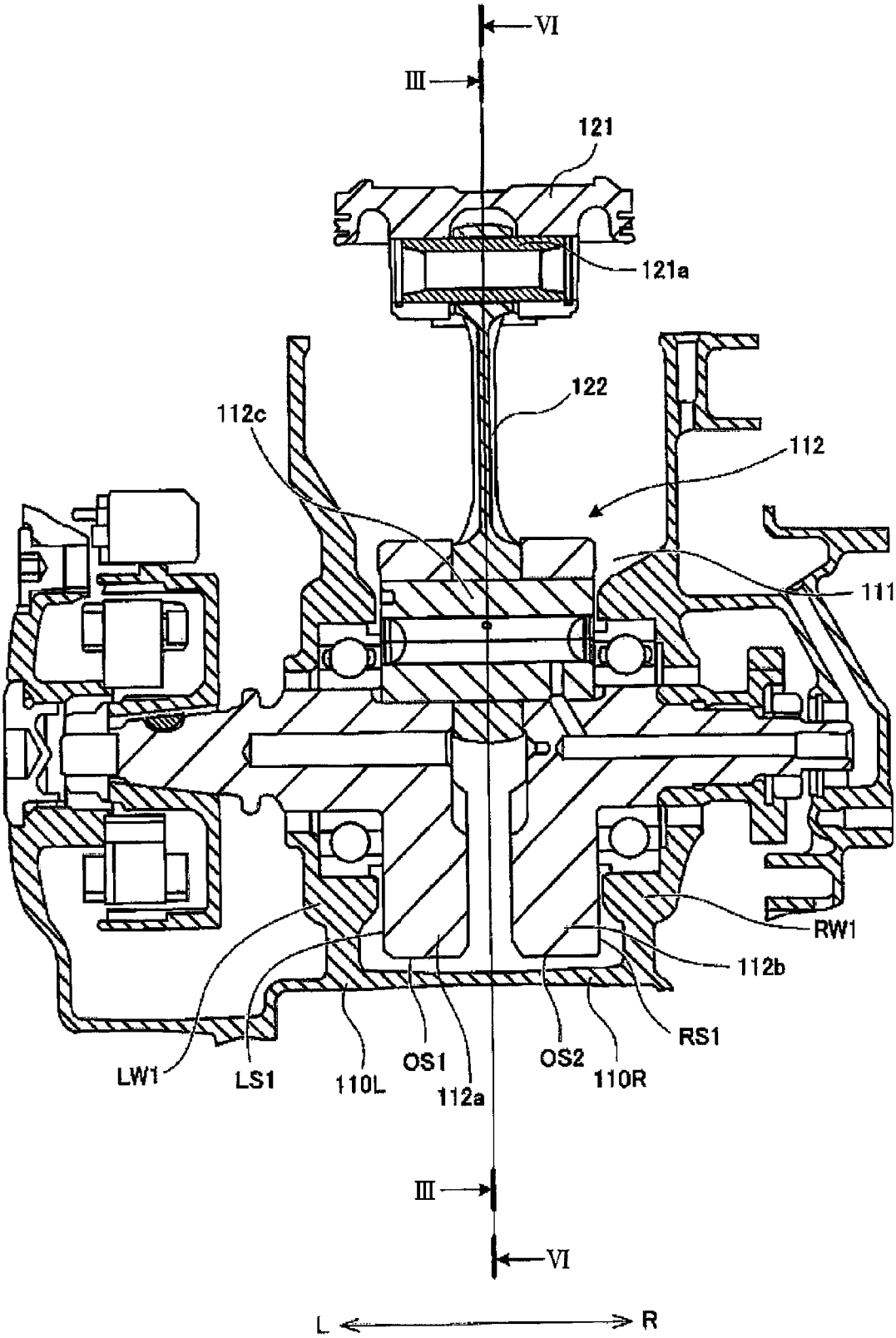
FIG. 5 is a schematic sectional view of the engine unit with a crankshaft being housed in a crank chamber, taken along the line V-V in FIG. 2.

FIG. 5 is a schematic sectional view of the engine unit 10 with the crankshaft 112 housed in the crank chamber 111. FIG. 5 shows a section taken in the direction of arrows V-V in FIG. 2 to show a position passing through the rotating shaft of the crankshaft 112. The crank webs 112*a* and 112*b* have disk shapes (cylindrical shape) extending perpendicularly to the rotating shaft, and have side surfaces in a direction of the rotating shaft (for example, left side surface LS1, right side surface RS1), and outer peripheral surfaces OS1 and OS2 on a radially outer side.

The left side surface LS1 of the crank web 112*a* and the right side surface RS1 of the crank web 112*b* face, respectively, wall surfaces of the crankcase 110 that partitions the crank chamber 111.

Specifically, the left side surface LS1 (outer side surface in the vehicle width direction) of the crank web 112*a* faces a right side surface (inner side surface in the vehicle width direction) of a left side wall LW1 extending perpendicularly to the vehicle width direction in the left crankcase 110L. The right side surface RS1 (outer side surface in the vehicle width direction) of the crank web 112*b* faces a left side surface (inner side surface in the vehicle width direction) of a right side wall RW1 extending perpendicularly to the vehicle width direction in the right crankcase 110R.

The engine oil, after lubricating the piston 121, the crankshaft 112, the cylinder 120, or the like, flows through a gap between the crankcase 110 and the crankshaft 112 into the oil reservoir 113. If the engine oil accumulates a portion between the crankshaft 112 and the crankcase 110 in a process of the engine oil flowing into the oil reservoir 113, rotational resistance of the crankshaft 112 increases. If the engine oil accumulating between the crankshaft 112 and the crankcase 110 is stirred by the crankshaft rotating at high speed, air may be mixed into the oil, which may cause oil film shortage in an area to be lubricated, thereby causing wear or seizure.

Thus, in the lubricating structure of the single cylinder engine according to the present embodiment, a groove for discharging oil is provided in a side wall of the crankcase 110 that partitions the crank chamber 111 so that the engine oil is quickly discharged from the crank chamber 111 to prevent a large amount of engine oil from adhering to the crankshaft 112.

The lubricating structure for the single cylinder engine according to the present embodiment will be described in more detail.

Figure 6:
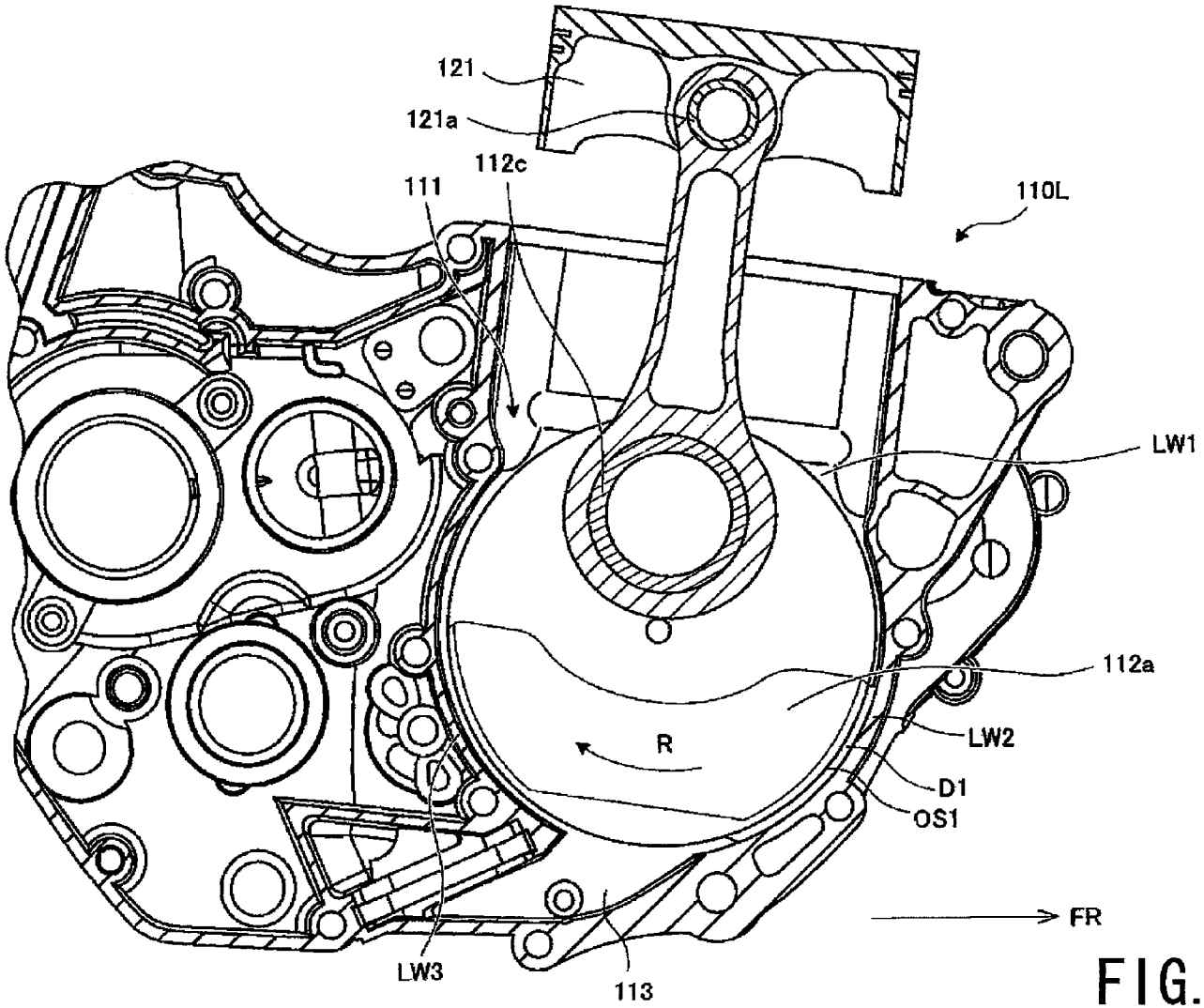
FIG. 6 is a sectional view of a crankcase taken along the line VI-VI in FIG. 5.
Figure 7:
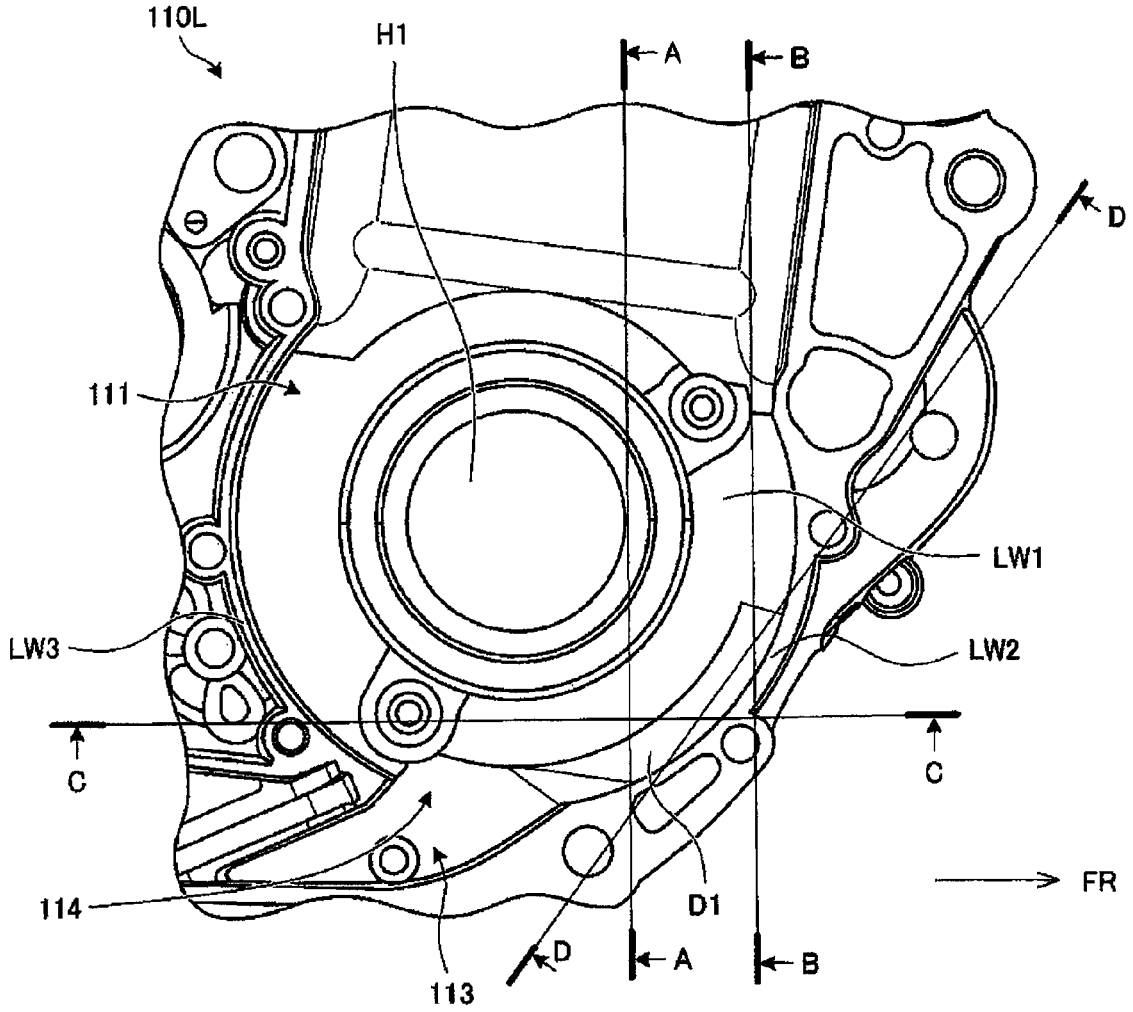
FIG. 7 is a right side view showing, in an enlarged scale, a left-side crankcase with the crankshaft being removed.
Figure 8:
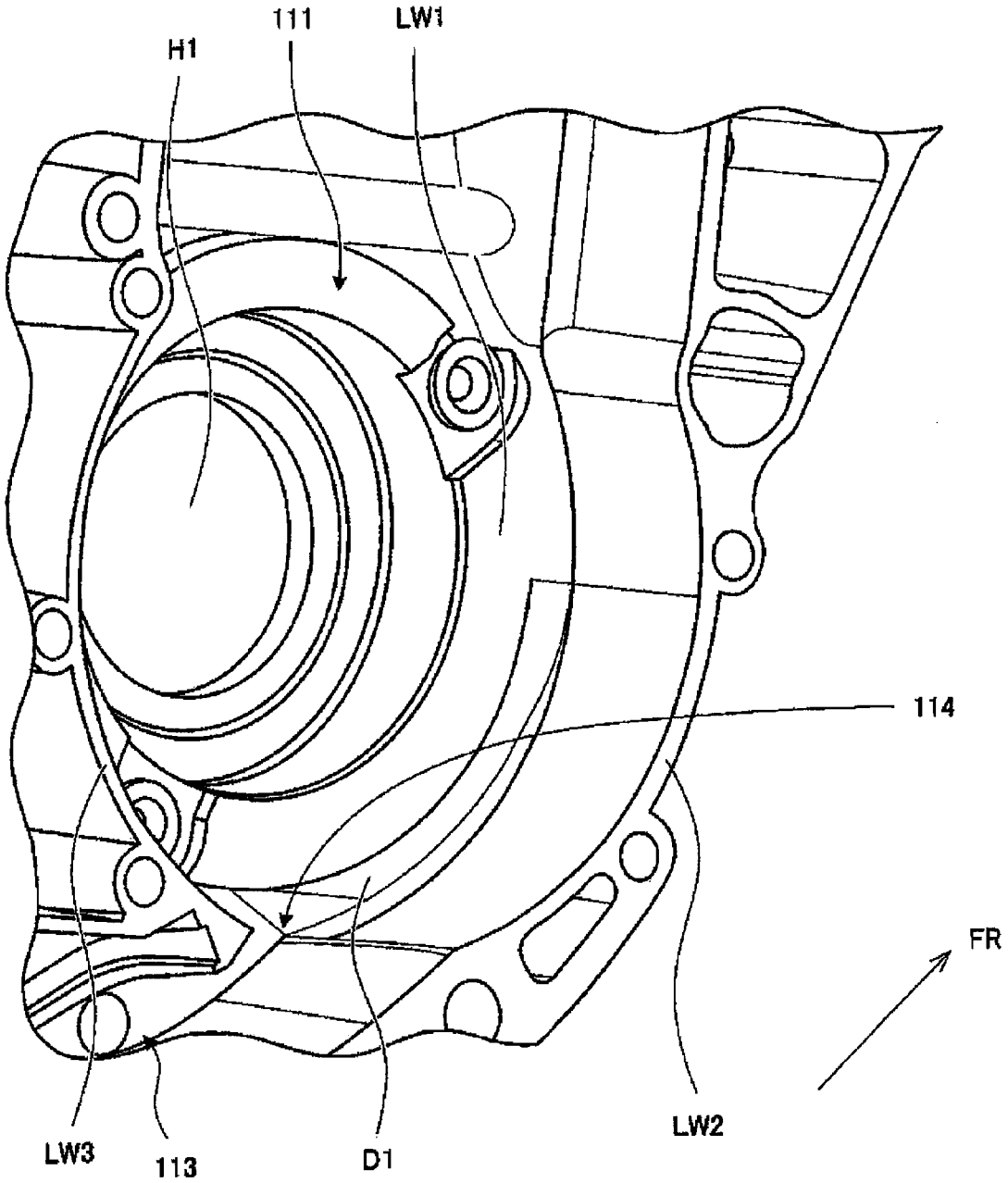
FIG. 8 is a perspective view of a right side surface of the left crankcase seen from an obliquely rear side.
Figure 9A:
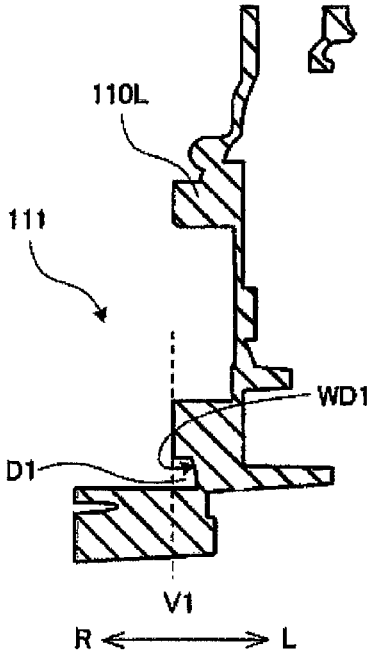
FIG. 9A shows a section taken in the direction of arrows A-A in FIG. 7.
Figure 9B:
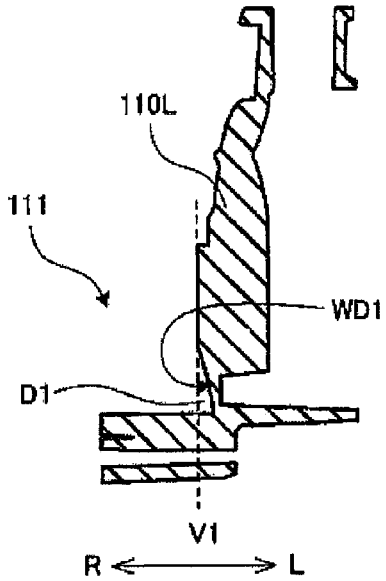
FIG. 9B shows a section taken in the direction of arrows B-B in FIG. 7.
Figure 9C:
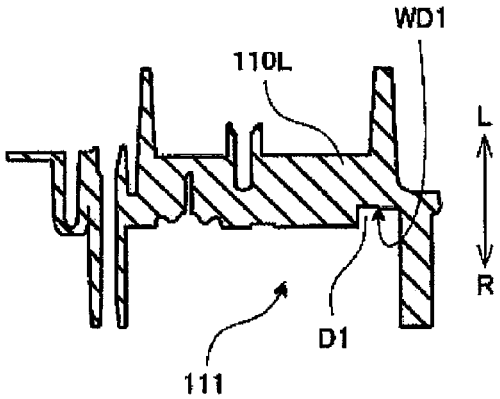
FIG. 9C shows a section taken in the direction of arrows C-C in FIG. 7.
Figure 9D:
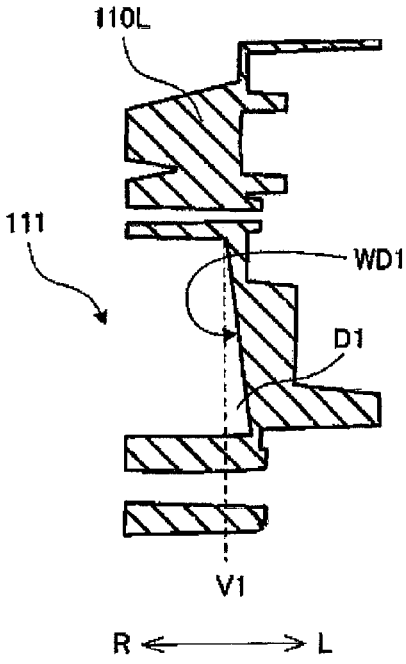
FIG. 9D shows a section taken in the direction of arrows D-D in FIG. 7.

FIG. 6 is a sectional view of the crankcase 110 with the crankshaft 112 being housed in the crank chamber 111 viewed in the direction of arrows in FIG. 5, FIG. 7 is a right side view showing, in an enlarged scale, the left crankcase 110L with the crankshaft 112 being removed, and FIG. 8 is a perspective view of a right side surface of the left crankcase 110L shown in FIG. 7 seen from an obliquely rear side.

As shown in FIGS. 6 to 8, the left crankcase 110L includes a left side wall LW1 extending in a direction substantially perpendicular to the vehicle width direction and a longitudinal (fore/aft) direction of the vehicle body, a left front side wall LW2 extending in a vertical direction of the vehicle body and the vehicle width direction in a front end of the left side wall LW1, and a left rear side wall LW3 extending in the vertical direction of the vehicle body and the vehicle width direction in a rear end of the left side wall LW1. The crank chamber 111 is partitioned by the left side wall LW1, the left front side wall LW2, and the left rear side wall LW3.

An opening H1, which has substantially circular shape and through which the rotating shaft of the crankshaft 112 is inserted, is formed in the left side wall LW1 of the left crankcase 110L. In the left side wall LW1, a region on a radially outer side of the opening H1 has constructed to be substantially flat so that a side surface of the region faces the left side surface LS1 of the crank web 112*a*.

In the left side wall LW1, in a position on a radially outer side of the opening H1 and on an inner side (side of the crank chamber 111) of the left front side wall LW2, an oil discharge groove D1 having a predetermined depth in the vehicle width direction is provided in a substantially arcuate shape around the rotating shaft of the crankshaft 112.

The oil discharge groove D1 is continuous with the oil reservoir 113 through the oil discharge port 114, and the engine oil flying (scattering) as droplets from the crank web 112*a* or the like can be discharged toward the oil reservoir 113. The left side wall LW1 of the left crankcase 110L includes the oil discharge groove D1, and thus, the engine oil flying from the crank web 112*a* can be efficiently discharged from the crank chamber 111.

The oil discharge groove D1 is provided so as to overlap an outer peripheral portion including the outer peripheral surface OS1 of the crank web 112*a* in a side view in FIG. 6. The engine oil adhering to the crank web 112*a* receives a centrifugal force of the crankshaft 112 and moves outward of the crank web 112*a*, and flies from the outer peripheral portion of the crank web 112*a*. Accordingly, the oil discharge groove D1 is provided in a position corresponding to the outer peripheral portion of the crank web 112*a*, and hence, the engine oil flying from the outer peripheral portion of the crank web 112*a* can be efficiently collected and discharged to the oil reservoir 113.

In the present embodiment, although the oil discharge groove D1 has a substantially arcuate shape around the rotating shaft of the crankshaft 112 in the side view, the oil discharge groove D1 may be formed to have a linear shape.

The oil discharge groove D1 is formed in a region from the position corresponding to the outer peripheral portion of the crank web 112*a* up to an end portion of the left side wall LW1. More specifically, in the side view in FIG. 6, the oil discharge groove D1 is formed to be wide in the radial direction of the crankshaft 112 so that an outer edge thereof is located in a cylindrical curved surface including an inner side surface of the left front side wall LW2. Accordingly, the oil discharge groove D1 is formed to the end portion of the left side wall LW1, and thus, the oil discharge groove D1 is widened to have a large capacity, thereby allowing a large amount of engine oil to be efficiently discharged.

The oil discharge groove D1 is provided below the rotating shaft of the crankshaft 112. In other words, the oil discharge groove D1 is provided under the central portion of the substantially circular opening H1 through which the rotating shaft of the crankshaft 112 is inserted. When the oil discharge groove D1 is provided above the rotating shaft of the crankshaft 112, the engine oil flowing through the oil discharge groove D1 may flow out from the oil discharge groove D1, thereby reducing discharge performance of the engine oil. If a large amount of engine oil that has flown out from the oil discharge groove D1 again adheres to the crankshaft 112, an increase in rotational resistance of the crankshaft 112, or mixture of air into the engine oil may again occur.

In contrast to such inconvenient, as in the present embodiment, the oil discharge groove D1 is provided below the rotating shaft of the crankshaft 112, and accordingly, the engine oil can be prevented from flowing out from the oil discharge groove D1 to increase discharge performance of the engine oil and prevent reoccurrence of the problems described above, thus being advantageous.

Further, the oil discharge groove D1 is provided on an upstream side of the oil discharge port 114 in the rotational direction of the crankshaft 112. In the sectional view in FIG. 6, the rotational direction of the crankshaft 112 is a clockwise direction (rotational direction R). Further, herein, the counterclockwise direction refers to a rotational direction when seen from a right side of the vehicle body (see FIGS. 6, 7, 8, or the like).

In this case, the oil discharge groove D1 is located in front of the oil discharge port 114. The engine oil mainly flows from the upstream side of the oil discharge port 114 toward the oil discharge port 114 in the rotational direction R of the crankshaft 112. Thus, the oil discharge groove D1 is provided on the upstream side of the oil discharge port 114, thereby increasing discharge performance of the engine oil. When the rotational direction of the crankshaft is a counterclockwise direction, the oil discharge groove D1 is provided at a rear of the oil discharge port 114.

FIG. 9 shows illustrated structures of the oil discharge groove D1 formed in the left crankcase 110L. With respect to the explanations of the respective FIGS. 9A to 9D, please refer to the brief description of the drawings.

As shown in FIGS. 9A to 9D, the oil discharge groove D1 is provided to be shallow in the vehicle width direction in an upper part thereof and be gradually deeper in a lower part. Specifically, the oil discharge groove D1 is formed to be deeper in the vehicle width direction toward the oil reservoir 113, and in the oil discharge groove D1, a wall surface WD1 in the vehicle width direction is inclined at a predetermined angle from a vertical direction V1.

According to such structures, the oil discharge groove D1 formed to be gradually deeper in the lower part is provided, so that the oil flowing along the wall surface due to a centrifugal force of the crankshaft 112 and a pressure wave in downward movement of the piston 121 can be guided away from the crank webs 112*a* and 112*b*. Therefore, the engine oil can be prevented from being stirred from the crank webs 112*a* and 112*b*, and thus, the discharge efficiency of the engine oil be enhanced.

A similar oil discharge groove is provided in the right crankcase 110R. Specifically, an oil discharge groove is also provided in the right side wall RW1 of the right crankcase 110R facing the right side surface RS1 of the crank web 112*b*. Detail of the oil discharge groove formed in the right crankcase 110R is substantially the same as the oil discharge groove D1 provided in the left crankcase 110L.

According to the single cylinder engine provided with the lubricating structure of the structure according to the present embodiment mentioned above, the engine oil adhering to the crankshaft 112 receives the centrifugal force by the rotation of the crankshaft 112 and moves radially outward of the crank webs 112*a* and 112*b*. Then, the engine oil flies (or scatters) as droplets radially outward of the crankshaft 112 from the outer peripheral portion including the outer peripheral surfaces OS1 and OS2 of the crank webs 112*a* and 112*b*, and partially flies to the left side wall LW1 and the right side wall RW1 of the crankcase 110.

Then, the flying engine oil flows through the oil discharge groove D1 provided in the left side wall LW1 and the oil discharge groove, not shown, provided in the right side wall RW1 and flows into the oil reservoir 113 through the oil discharge port 114.

As described above, according to lubricating structure for the single cylinder engine of the present embodiment, most of the engine oil flows through the oil discharge groove D1 into the oil reservoir 113, thereby increasing discharge performance of the engine oil, and sufficiently reducing the amount of engine oil that comes into contact with the crankshaft 112, thus being advantageous.

Furthermore, according to the lubricating structure for the single cylinder engine of the above embodiment, since the oil discharge grooves D1 are provided in the side surfaces of the crank webs 112*a* and 112*b*. The oil discharge groove D1 provided in the side wall of the crankcase 110 functions as a main discharge path of the oil, the radial gap between the crank webs 112*a* and 112*b* and the crankcase 110 can be sufficiently small within a range in which the drag resistance of the oil is not excessively increased. Specifically, the crankcase may have a sufficiently small size in the radial direction of the crank web.

Meanwhile, when the radial gap between the crank web and the crankcase is a main discharge path of the oil, the gap between the crank web and the crankcase has to be widened in order to sufficiently increase oil discharge performance. In particular, on the upstream side in the crankshaft rotational direction, it is needed to ensure a sufficiently wide radial space between the inner surface of the crankcase and the outer periphery of the crank web in order to ensure the discharge path. If such wide space is ensured, the crankcase is widened in the radial direction of the crank web, resulting in the increasing in the size of the engine. To cure such defect, according to the lubricating structure of the present embodiment, the oil discharge grooves D1 are located in the side surfaces of the crank webs 112*a* and 112*b*, thus solving the above mentioned defect.

As described above, according to the single cylinder engine provided with the improved lubricating structure of the present invention, the oil discharge groove is provided in the side wall of the crankcase facing the side surface of the crank web, and thus, the oil flying (scattering) from the crank web can be efficiently discharged from the crank chamber to sufficiently reduce an amount of oil that comes into contact with the crankshaft.

Furthermore, since the present lubricating structure does not require a narrow space between the inner surface of the crankcase and the outer peripheral surface of the crank web, the increasing in the rotational resistance of the crankshaft can be prevented.

In addition, the oil discharge groove is provided in the side wall of the crankcase facing the side surface of the crank web, there is no need to widen the space between the crankcase and the crank web, and also no need to widen the crankcase in the radial direction of the crank web. Accordingly, the lubricating structure for the single cylinder engine according to the present invention can increase discharge performance of the oil from the crank chamber without increasing the rotational resistance of the crankshaft and without widening the crankcase in the radial direction of the crank web.

As described hereinabove, although the present invention is particularly effective for a single cylinder engine having an improved lubricating structure in which the oil discharge groove can be provided correspondingly to each crank web, the described lubricating structure may be applied to different cylinder engines. In an application to other cylinder engine, an oil discharge groove may be provided in a side wall of a crankcase, thereby increasing discharge performance of oil from the crank chamber without increasing rotational resistance of a crankshaft.

As described above, it is to be noted that the present invention is not limited to the described embodiment, and many other changes and modifications or alternations may be made without departing from the scope of the appended claims.

For example, in the above embodiment, although the oil discharge grooves are provided in both the left and right side walls of the crankcase, an oil discharge groove may be provided only in one of the left and right side walls of the crankcase. In addition, in the described embodiment, although the crank web has a substantially disk shape, a crank web may have a different shape according to use.

What is claimed is:

1. An engine provided with a lubricating structure, comprising:

a crankcase having a crank chamber;

a crankshaft disposed in the crank chamber of the crank case and having a crank web with a side surface thereof perpendicular to the crankshaft; and a lubricating structure for lubricating an oil to components in the engine, the lubricating structure including an oil reservoir communicating with the crank chamber through an oil discharge port formed to a bottom portion of the crank chamber, and an oil discharge groove formed to a side surface of the crankcase continuous to the bottom portion of the crank chamber and configured to discharge oil flying from the crank web into the oil reservoir, the oil discharge groove being provided in a side wall of the crankcase facing the side surface of the crank web in the crank chamber and configured such that the oil discharge groove is provided to be shallow in the vehicle width direction in an upper part of the oil discharge groove thereof and to gradually deepen towards a lower part of the oil discharge groove thereof.

2. The engine provided with the lubricating structure of claim 1, wherein the engine is a single cylinder engine.

3. The engine provided with the lubricating structure of claim 2, wherein the crank web has a disk shape and the oil discharge groove has a circular arc shape around the crankshaft in a region corresponding to an outer peripheral portion of the crank web.

4. The engine provided with the lubricating structure of claim 2, wherein the oil discharge groove is provided up to an end portion of the side wall of the crankcase.

5. The engine provided with the lubricating structure of claim 2, wherein the oil discharge groove is provided to be deeper in a vehicle width direction toward the oil reservoir.

6. The engine provided with the lubricating structure of claim 2, wherein the oil discharge groove is provided below the crankshaft.

7. The engine provided with the lubricating structure of claim 2, wherein the oil discharge groove is provided on an upstream side of the oil discharge port in a rotational direction of the crankshaft.

* * * * *